US010252311B2

(12) United States Patent
Grimm et al.

(10) Patent No.: US 10,252,311 B2
(45) Date of Patent: Apr. 9, 2019

(54) FORMING TOOL FOR SHAPING A WORKPIECE, AND METHOD FOR POSITIONING A TEMPERATURE CONTROL DEVICE ON A FORMING TOOL

(71) Applicant: Bayerische Motoren Werke Aktiengesellschaft, Munich (DE)

(72) Inventors: Joerg Grimm, Ruhla OT Kittelsthal (DE); Matthias Hahnel, Wolfsburg-Unkeroda (DE); Jochen Lietz, Jessen (DE); Christian Mueller, Eisenach (DE); Horst Reuss, Unterschoenau (DE); Lutz Sagner, Waltershausen (DE); Thomas Schrumpf, Bad Salzungen (DE); Richard Schwimmbeck, Adlkofen (DE); Ernst Heinl, Zolling (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 0 days.

(21) Appl. No.: 15/244,350

(22) Filed: Aug. 23, 2016

(65) Prior Publication Data

US 2016/0354827 A1 Dec. 8, 2016

Related U.S. Application Data

(63) Continuation of application No. PCT/EP2015/051883, filed on Jan. 30, 2015.

(30) Foreign Application Priority Data

Feb. 24, 2014 (DE) ..... 10 2014 203 279
Apr. 25, 2014 (DE) ..... 10 2014 207 869

(51) Int. Cl.
*B21D 22/20* (2006.01)
*B21D 22/02* (2006.01)
*B21D 37/16* (2006.01)

(52) U.S. Cl.
CPC ..... *B21D 22/208* (2013.01); *B21D 22/022* (2013.01); *B21D 37/16* (2013.01)

(58) Field of Classification Search
CPC ..... B21D 22/208; B21D 22/022; B21D 37/16
See application file for complete search history.

(56) References Cited

U.S. PATENT DOCUMENTS 4,655,280 A * 4/1987 Takahashi ..... B29C 45/7312 164/348
2008/0003325 A1* 1/2008 Seaver ..... B22C 9/065 425/552

(Continued)

FOREIGN PATENT DOCUMENTS

CH 598 884 A5 5/1978
CN 103003003 A 3/2013

(Continued)

OTHER PUBLICATIONS

International Search Report (PCT/ISA/210) issued in PCT Application No. PCT/EP2015/051883 dated Apr. 29, 2015, with English translation (four (4) pages).

(Continued)

*Primary Examiner* — Teresa M Ekiert
(74) *Attorney, Agent, or Firm* — Crowell & Moring LLP

(57) ABSTRACT

A forming tool for shaping a workpiece, in particular a flat metal sheet, includes a female die, a blank holder, and a male die, all of which are movable relative to one another. The female die, the blank holder and/or the male die may be temperature-controlled in at least some portions thereof.

12 Claims, 1 Drawing Sheet

(56) References Cited

U.S. PATENT DOCUMENTS

| | | | | |
|---|---|---|---|---|
| 2011/0232354 | A1 | 9/2011 | Hielscher et al. | |
| 2013/0205863 | A1 | 8/2013 | Loesch | |
| 2014/0008031 | A1 | 1/2014 | Angermeier et al. | |
| 2014/0044585 | A1* | 2/2014 | Naitou | C23C 2/40 420/90 |
| 2014/0096583 | A1* | 4/2014 | Cho | B21D 22/208 72/332 |

FOREIGN PATENT DOCUMENTS

| | | | |
|---|---|---|---|
| CN | 103056212 | A | 4/2013 |
| DE | 10 2010 012 579 | B3 | 7/2011 |
| DE | 10 2010 027 554 | A1 | 1/2012 |
| DE | 10 2010 063 468 | A1 | 6/2012 |
| DE | 10 2011 051 943 | A1 | 1/2013 |
| DE | 10 2013 021 229 | A1 | 7/2014 |
| EP | 1 990 109 | A1 | 11/2008 |
| EP | 2 567 763 | A1 | 3/2013 |

OTHER PUBLICATIONS

German Search Report issued in counterpart German Application No. 10 2014 203 279.2 dated Oct. 6, 2014, with partial English translation (eleven (11) pages).

Chinese-language Office Action issued in counterpart Chinese Application No. 201580004290.X dated Mar. 20, 2017 with English translation (eighteen (18) pages).

* cited by examiner

FORMING TOOL FOR SHAPING A WORKPIECE, AND METHOD FOR POSITIONING A TEMPERATURE CONTROL DEVICE ON A FORMING TOOL

CROSS REFERENCE TO RELATED APPLICATIONS

This application is a continuation of PCT International Application No. PCT/EP2015/051883, filed Jan. 30, 2015, which claims priority under 35 U.S.C. § 119 from German Patent Application No. 10 2014 203 279.2, filed Feb. 24, 2014 and 10 2014 207 869.5, filed Apr. 25, 2014, the entire disclosures of which are herein expressly incorporated by reference.

BACKGROUND AND SUMMARY OF THE INVENTION

The embodiments of the present invention relate to a forming die for shaping a workpiece, in particular a flat metal sheet, and to a method for arranging a temperature-control device on a forming die.

Forming apparatuses or forming dies which serve for example for the shaping of metal sheets in presses usually have a female part with a shaping surface and a male part, for example a punch, having a separate shaping surface that corresponds to the shaping surface of the female part. The metal sheet is introduced between the female part and the punch and formed by way of a relative movement of the punch in the direction of the female part or by way of a movement of the female part in the direction of the punch, wherein the metal sheet is clamped between the female part and the punch. In order to improve the forming result and in order to avoid bending up of the workpiece to be formed, i.e. the metal sheet, in the peripheral regions of the female part, holding-down means are used. These holding-down means, also known as blank holders, hold the metal sheet against the female part so that it cannot bend up. In addition, the holding-down means ensure continued flowing of the sheet material so that stress cracks are avoided.

The forming die has regions with lower degrees of forming and regions with higher degrees of forming. In regions with a high degree of forming, strong deformation of the workpiece, i.e. of the metal sheet, occurs. Tests have shown that the metal sheet can crack in these regions. This crack formation is attributable to the fact that, at a high workpiece frequency, or number of strokes, the die heats up in sections with high degrees of forming. As a result, high temperatures, which are above room temperature or exceed the temperature which the metal sheet exhibits prior to forming, are achieved in these sections. During the forming of a metal sheet, friction occurs between the metal sheet and the forming die, in particular in regions with high degrees of forming, with the result that the die heats up. This results in expansion of the die and thus to a change in shape. Depending on the friction and degree of forming, locally different expansions of the die occur. As a result, the available space for a subsequent metal sheet to be formed is reduced at these points, and so cracks can occur.

Such problems require reworking of the die. In this case, one or more segments of a forming die half are cut out, i.e. the female part or the male part. Inserts which are provided with a plurality of holes are then introduced into these cutouts. These holes are combined with one another such that a cooling circuit can be produced in an insert. In this case, a first hole is produced from an outer side of the die insert. Subsequently, a second hole is positioned such that it intersects the first hole inside the die insert. According to this method, a plurality of holes are introduced. Subsequently, openings on the surface of the die insert that are not required are closed off by plugs, apart from an inlet and an outlet. This results in a cooling circuit through which a medium can flow. Subsequently, the insert is inserted into the female part or the male part. However, this method has the disadvantage that the cast structure of the female part, the male part or the blank holding-down means is no longer cohesive, but consists of different individual parts (cast structure and insert). In particular when the female part is formed from a cast material, there is the risk that the female part will be destroyed during use as intended. The separation of a segment from the forming die made of cast material thus represents a weakening of the cast structure. If, for example, the punch now forms the workpiece and passes into the male part together with the metal sheet, it generates a pressure load on the female part, which can act in the radial direction and in the axial direction in the cavity. This pressure load can have the result that the die half having a weakened cast structure is destroyed.

As an alternative to the introduction of cooling ducts, it is possible to completely remake the die. In this case, it is also possible for new dies to be provided with inserts from the outset, wherein the cast structure of these inserts is optimized. However, this represents an extremely unsatisfactory solution economically.

an object of the embodiments of the present invention is to specify an alternative solution with which regions of a forming die which have a high degree of forming are temperature-controllable. An exemplary object of the embodiments of the invention is to specify a forming die and a method with which subsequent temperature control or cooling of critical regions of the forming die is realizable.

This and other objects are achieved by a forming die for shaping a workpiece, in particular a flat metal sheet, having a female part, a holding-down means and a male part, which are each arranged in a movable manner with respect to one another, wherein at least the female part, the holding-down means and/or the male part are temperature-controllable in some sections. In other words, at least one of the three elements can be provided with one or more temperature-control devices in one portion. Advantageously, the temperature-control device is fitted in the vicinity of regions of the forming die in which high degrees of forming are achieved, known as critical regions.

Furthermore, the female part, the holding-down means and/or the male part can have in some sections at least one shaping insert which is temperature-controllable. The temperature-control unit can as a result also be provided in individual segments or in individual elements of the forming die or forming die halves.

Moreover, for temperature control, at least one depression, in particular a blind hole, can be provided, through which a medium is flushable. Such depressions, for example blind holes, can be introduced into the forming die particularly easily. This can take place both during the new production of the die and subsequently during reworking or optimization of an existing forming die. The flushing of the depression with a medium affords the advantage that, by regulation or control of the supply temperature of the medium, the temperature of the die is continuously settable in the critical region of the die.

In addition, a baffle can be introduced into the depression in order to guide the medium. As a result, a flow duct in which the medium can flow along the baffle from an inlet to the die-side inner end of the blind hole, can be realized easily. At this inner end of the blind hole, the medium is deflected and guided along the baffle again to an outlet.

In addition, the surface of the die can be provided in the depression with a sealant. This affords advantages in particular when the die is formed from a porous material, for example a cast material. Since cast materials are permeable, the coolant can pass into the material of the die. In order to prevent this, according to this embodiment, the surface of the die is sealed off with the aid of a sealant at least within the depression. For this purpose, all sealants with which casting pores are able to be closed off are suitable, for example cooler sealants, waterglass, etc. Such sealants are admixed to the coolant and passed through the flow duct or the cooling system before the die is put into operation. As a result, the pores of the cast material, which are located on the surface of the die in the region of the depression, are closed off in a particularly easy and practical manner. Alternatively, for the purpose of sealing off, the surface of the depression can be provided with a coat of paint, a casting resin or adhesive. Furthermore, the surface can also be sealed off by tinning with soft solder.

Further, the baffle can be arranged in an insert, for example a sleeve, such that the medium is guided between the baffle and the inner wall of the sleeve. The use of a sleeve affords advantages in particular when the forming die is formed from a material which is not impermeable. For example, when the forming die consists of cast material such as gray cast iron, the sleeve produces a vessel which is impermeable with regard to the medium and in which the medium can be guided.

Further, the outer wall of the sleeve can be in touching contact with the inner wall of the depression. The larger the contact area is, for example by the creation of fitting accuracy between the outer wall of the sleeve and the inner wall of the depression in the die, the better the heat transfer from the medium via the sleeve into the die and vice versa. In other words, the better the fitting accuracy between the sleeve and die, the better the thermal transfer or dissipation of heat from the die into the medium. A tight fit has proved particularly expedient here. Tight fits within the meaning of the invention are clearance fits with little clearance, wherein fitting or removal is possible without tools, i.e. by hand.

For a further improvement in the heat transfer, the sleeve can be formed from a material with high thermal conductivity. Copper or similar materials are suitable in particular as such a material.

Alternatively or in addition, the outer wall of the sleeve can be provided with a heat-conducting means, in particular a heat-conducting coating or a heat-conducting paste. Further, a method for arranging a temperature-control device on a forming die for shaping a workpiece, in particular a flat metal sheet, having a female part, a holding-down means and a male part, includes the acts of identifying a critical region of the die with a high degree of forming, determining the position for the arrangement of the temperature-control device in the female part, the male part and/or the holding-down means, producing at least one depression at the predetermined position in the female part, the male part and/or the holding-down means, introducing a baffle into the depression, wherein an inlet for introducing a medium into the depression and an outlet for discharging the medium from the depression are provided, and connecting the inlet and outlet to a cooling unit.

With this method, a temperature-control unit can be provided easily and cost-effectively in or on a forming die. This method is suitable particularly for the subsequent installation of a temperature-control unit in a forming die.

Furthermore, an insert, for example a sleeve, can be introduced into the depression. As already mentioned at the beginning, the sleeve affords the advantage that cooling can be realized even in forming dies which are formed from a porous material through which the medium can flow.

Further, after the depression has been produced, the surface of the die can be provided in the depression with a sealant. To this end, a sealant is introduced into the depression, the sealant closing off the pores of the material of which the die consists. Such sealants are admixed to the coolant and passed through the flow duct or the cooling system before the die is put into operation. As a result, the pores of the cast material, which are located on the surface of the die in the region of the depression, are closed off in a particularly easy and practical manner. Alternatively, for the purpose of sealing off, the surface of the depression can be provided with a coat of paint, a casting resin or adhesive. Furthermore, the surface can also be sealed off by tinning with soft solder. As a result of the die material being sealed off, it is possible to dispense with the use of a sleeve. Thus, as a result of the number of components being reduced, the method is streamlined.

Suitable media for the temperature-control or cooling of the forming die are gaseous or liquid media, for example water, oils or emulsions. Water, optionally provided with an antifreeze, is also suitable, for example, for use as the medium or as the coolant. As a result, the medium can be temperature-controlled to temperatures below 0° C.

The embodiments of the invention are explained in more detail in the following text by way of the description of the figures. The claims, the figures and the description contain a multiplicity of features which are explained in the following text in connection with embodiments of the present invention that are described by way of example. A person skilled in the art will also consider these features individually and in other combinations in order to form further embodiments which are adapted to corresponding applications of the invention. Other objects, advantages and novel features of the embodiments of the present invention will become apparent from the following detailed description of one or more preferred embodiments when considered in conjunction with the accompanying drawings.

DETAILED DESCRIPTION OF THE DRAWINGS

Figure 1:
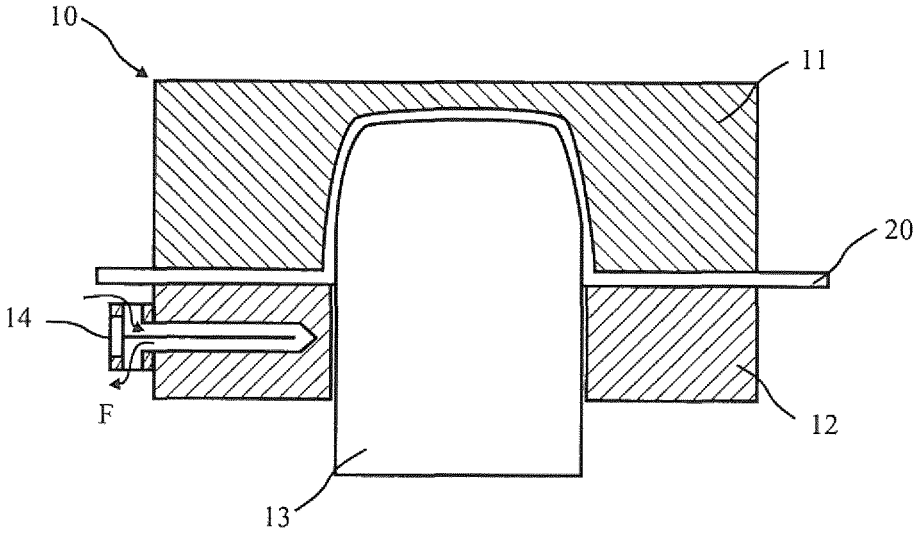
FIG. 1 s a sectional illustration through a forming die.

FIG. 1 shows a forming die 10 which includes a female part 11, a holding-down means 12 and a male part in the form of a punch 13. By way of the forming die 10, a workpiece 20 can be shaped. FIG. 1 shows the end of the forming process. The female part 11, the holding-down means 12 and the punch 13 are mounted so as to be movable relative to one another; in FIG. 1, such a direction of movement would correspond to the vertical direction. A metal sheet 20, originally extending in a flat manner, is introduced between the female part 11 and the holding-down means 12 and pressed against the female part 11 with the aid of the holding-down means 12. Thereafter, the punch 13 is moved relative to the male part 11, wherein it forms a section of the workpiece 20. Forming of the metal sheet 20 into a pot-like or cup-like component takes place by way of example and in a nonlimiting manner in FIG. 1. During forming, not only the workpiece 20 but also the die 10 heats up in critical regions. This takes place in particular at a high forming rate or number of strokes, in which six to eight or more components are formed per minute. Such critical regions are, for example, in FIG. 1, regions between the punch 13 and the female part 11 which extend substantially virtually parallel to the direction of movement, i.e. to the vertical direction of the punch 10 and the transition regions between the substantially parallel regions and the regions located substantially perpendicularly to the direction of movement of the punch.

In order to prevent or reduce heating in these regions, a temperature-control unit is provided in the holding-down means 12. The temperature-control unit is formed as a blind hole which extends from left to right in FIG. 1. A baffle 14 which acts as a horizontal partition wall has been introduced into the blind hole from the left. This blind hole can be flushed with a liquid or gaseous medium, wherein a flow is established which is illustrated by the arrows labeled F in FIG. 1. The medium is introduced through an inlet opening into the region between the baffle 14 and the wall of the blind hole. It flows from left to right in FIG. 1 as far as the die-internal end of the blind hole, is deflected there and then flows through the lower duct from right to left in FIG. 1 as far as the outlet opening. The cooling effect consequently propagates from the left-hand region of the holding-down means 12, via the workpiece 20 and into the female part 11.

Although the temperature control is illustrated in the holding-down means 12 in FIG. 1, this is only one exemplary embodiment. In other embodiments of the invention, the temperature control can also be provided in the female part 11 or—given corresponding accessibility—in the punch 13.

FIG. 1 is also by way of example and nonlimiting in that the temperature control is introduced directly in an element of the forming die 10. Alternatively, the female part 11, the punch 13 or the holding-down means 12 can also consist of individual shaping sections, wherein the temperature-control unit can be arranged in one shaping section. Advantageously, the individual parts, illustrated in FIG. 1, of the forming apparatus 10 are made of hardened steel. This is impermeable with regard to the medium.

Where use is made of a die which consists of a porous material such as cast materials, impermeability with regard to the coolant can be achieved in that the depression is provided with a sealant. In this case, the pores in the depression, i.e. at the surface of the walls which bounds the depression, are closed.

Figure 2:
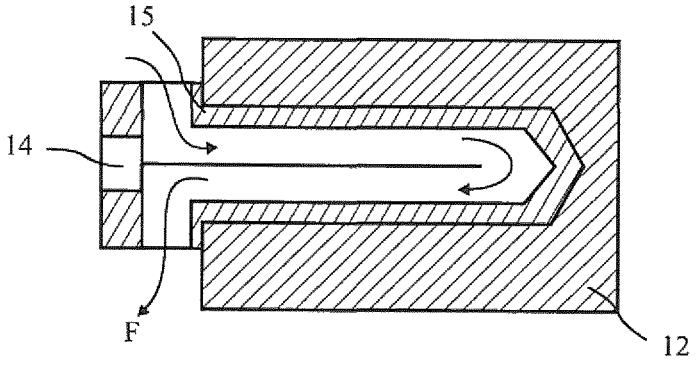
FIG. 2 is a sectional illustration through a holding-down means.

With regard to FIG. 2, an embodiment is outlined which can be applied particularly advantageously in forming apparatuses in which individual elements or individual segments, i.e. forming sections, are formed from medium-permeable material. FIG. 2 shows an enlarged illustration of the holding-down means 12 from FIG. 1. The baffle 12 is still introduced into the blind hole, although it is not arranged directly in the blind hole but is additionally surrounded by a sleeve 15. The sleeve 15 is formed from a medium-impermeable material. Furthermore, the outer surface of the sleeve 15 is in touching contact with the inner surface of the depression. As a result, particularly good heat transfer from the medium which flows in the sleeve 15, via the sleeve 15 to the holding-down means 12 can be ensured. As already explained with regard to FIG. 1, the direction of flow of the medium is shown by the arrows in FIG. 2 which are labeled F, wherein an inlet is illustrated at the top of FIG. 2, through which the medium passes into a duct which is defined by the baffle 14 and by the inner surface of the housing 15. In these chambers, the medium flows from left to right in FIG. 2 as far as the deflection region and then from right to left as far as the outlet from which it flows out of the temperature-control device. In this embodiment, too, the temperature-control device can be fitted into the holding-down means 12, into the punch 13 or into the female part 11 instead.

In both embodiments, the inlet and the outlet are connected to a cooling unit via a hose connection via simple annular tubing with a fitting pressure hose. Alternatively to the connection via a hose, pipe connections can also be used. As a result, a cooling circuit is produced in which the medium flows from the cooling unit to the inlet to the die, through the temperature-control device and from the outlet back to the cooling unit. The cooling unit temperature-controls the medium to a predetermined temperature.

The invention affords advantages in that existing or else new forming press dies can be provided with cooling with very little effort and at low risk in critical forming regions.

The advantages of the embodiments of the invention will be summarized briefly once again in the following text. With the above-described apparatus and the method, cooling can be realized at any time in forming dies made of cast material or steel. By way of steel inserts in the form of a sleeve 15, no material weakening takes place in the cast component, as has hitherto been the case. Furthermore, the embodiments of the invention provide great flexibility with regard to the number, position and location of the cooling ducts, i.e. of the depressions and of the blind holes. In this connection, it should also be noted that, if additionally required, further cooling holes can be introduced subsequently into the forming tool. By way of the cooling, a greater number of strokes are enabled in the pressing of metal sheets or metal plates, and so more parts are introducible per unit time. In addition, the efficiency of use of the press is increased at very critical press parts.

The foregoing disclosure has been set forth merely to illustrate the embodiments of the invention and is not intended to be limiting. Since modifications of the disclosed embodiments incorporating the spirit and substance of the invention may occur to persons skilled in the art, the embodiments of the invention should be construed to include everything within the scope of the appended claims and equivalents thereof.

What is claimed is:

1. A forming die for shaping a flat metal sheet, the forming die comprising:

a female part;

a holding-down device;

a male part, the female part, the holding-down device, and the male part being each arranged in a movable manner with respect to one another; and a temperature control unit that is formed in the holding-down device, wherein the temperature control unit includes a blind hole that extends from an end of the holding-down device toward the male part, and a baffle partitions the blind hole from the end of the holding-down device toward the male part, the baffle having a first end thereof outside of the holding-down device and being configured to guide a liquid or gaseous medium, to thereby control a temperature of the blind hole.

2. The forming die as claimed in claim 1, wherein the female part, the holding-down device and/or the male part have in some sections at least one shaping portion which is temperature-controllable.

3. The forming die as claimed in claim 1, wherein a surface of the forming die is provided with a sealant.

4. The forming die as claimed in claim 3, wherein the baffle is arranged in a sleeve such that the liquid or gaseous medium is guided between the baffle and an inner wall of the sleeve.

5. The forming die as claimed in claim 4, wherein an outer wall of the sleeve is in touching contact with an inner wall of the blind hole.

6. The forming die as claimed in claim 5, wherein the sleeve is formed from a material with high thermal conductivity.

7. The forming die as claimed in claim 6, wherein the outer wall of the sleeve is provided with a heat-conducting coating or a heat-conducting paste.

8. The forming die as claimed in claim 5, wherein the outer wall of the sleeve is provided with a heat-conducting coating or a heat-conducting paste.

9. The forming die as claimed in claim 4, wherein an outer wall of the sleeve is provided with a heat-conducting coating or a heat-conducting paste.

10. A method for using a temperature-control unit on a forming die, the method comprising the acts of:

identifying a critical region on the forming die with a high degree of forming, the forming die being configured to shape a flat metal sheet, having a female part, a holding-down device and a male part;

forming the temperature-control unit in the holding-down device, wherein the temperature-control unit includes a blind hole that extends from an end of the holding-down device toward the male part, and a baffle partitions the blind hole from the end of the holding-down device toward the male part, the baffle having a first end thereof outside of the holding-down device and being configured to guide a liquid or gaseous medium, to thereby control a temperature of the blind hole.

11. The method as claimed in claim 10, further comprising:

introducing a sleeve into the blind hole.

12. The method as claimed in claim 10, wherein after the temperature control unit has been formed, a surface of the forming die is provided with a sealant.

* * * * *